US010072906B2

(12) United States Patent
Eberle

(10) Patent No.: US 10,072,906 B2
(45) Date of Patent: Sep. 11, 2018

(54) BACKPACK FOR CARRYING WEAPONS

(71) Applicant: Eberlestock USA LLC, Boise, ID (US)

(72) Inventor: Glen R. Eberle, Boise, ID (US)

(73) Assignee: Eberlestock USA LLC, Boise, ID (US)

( * ) Notice: Subject to any disclaimer, the term of this patent is extended or adjusted under 35 U.S.C. 154(b) by 0 days.

(21) Appl. No.: 15/366,321

(22) Filed: Dec. 1, 2016

(65) Prior Publication Data

US 2017/0153086 A1 Jun. 1, 2017

Related U.S. Application Data

(60) Provisional application No. 62/261,630, filed on Dec. 1, 2015.

(51) Int. Cl.
*F41C 33/00* (2006.01)
*A45F 3/06* (2006.01)

(52) U.S. Cl.
CPC ..... *F41C 33/002* (2013.01); *A45F 3/06* (2013.01)

(58) Field of Classification Search
CPC ..... F41C 33/002; F41C 23/02; A47B 81/005
USPC ..... 224/149, 150, 913, 915
See application file for complete search history.

(56) References Cited

U.S. PATENT DOCUMENTS 2,715,989 A * 8/1955 Sjodin ..... A45F 5/00 224/624
2,884,172 A * 4/1959 Kubo ..... F41C 23/02 224/149
5,184,764 A * 2/1993 Orovan ..... A45F 3/08 224/262
5,664,721 A * 9/1997 Homeyer ..... A01K 97/08 224/149
5,676,293 A * 10/1997 Farris ..... A45F 3/04 2/175.7
5,975,389 A * 11/1999 Braun ..... A01M 31/02 182/187
6,260,748 B1 * 7/2001 Lindsey ..... F41C 33/001 224/150
6,290,114 B1 * 9/2001 Berberian ..... A45F 3/04 224/637
6,619,519 B1 * 9/2003 Nix ..... A45C 7/0086 224/153
6,763,987 B1 7/2004 Eberle
7,488,038 B2 * 2/2009 Boyle ..... B60N 2/2806 297/250.1
7,654,426 B2 * 2/2010 Eberle ..... A45F 3/04 224/637
7,735,701 B2 6/2010 Eberle
8,245,825 B2 * 8/2012 Yoneno ..... A45C 5/14 190/103
8,397,965 B2 * 3/2013 Eberle ..... A45F 3/04 224/637

(Continued)

*Primary Examiner* — Brian D Nash
(74) *Attorney, Agent, or Firm* — Taylor IP, P.C.

(57) ABSTRACT

A backpack for carrying a weapon that includes a main body with a first shoulder strap and a second shoulder strap attached thereto. The backpack additionally includes a weapon carrier that has a lower pocket attached to a lower portion of the backpack for receiving an end of the weapon, and a tether having a first end and a second end respectively attached to the first and second shoulder straps of the backpack. When the weapon is positioned in the lower pocket, the tether wraps around the weapon to secure the weapon against an outer periphery of the main body of the backpack.

9 Claims, 2 Drawing Sheets

(56) References Cited

U.S. PATENT DOCUMENTS 8,678,019 B2 * 3/2014 Christie ..... A45F 4/02 135/16
8,870,045 B1 * 10/2014 Aguirre ..... A45F 3/04 224/581
9,044,080 B2 * 6/2015 Ashenafi ..... A45F 3/14
9,194,655 B1 * 11/2015 Cha ..... A45F 3/14
9,198,497 B2 * 12/2015 Elam ..... A45F 3/00
9,510,661 B2 * 12/2016 Murdoch ..... A45F 3/005
9,784,531 B1 * 10/2017 Baker ..... F41C 33/06
2005/0000995 A1 * 1/2005 Eberle ..... A45F 3/04 224/637
2005/0040199 A1 * 2/2005 Lemens ..... A45F 3/14 224/637
2005/0066426 A1 * 3/2005 White ..... A45F 3/12 2/271
2005/0092790 A1 * 5/2005 Guarniere ..... F41C 33/005 224/149
2007/0145091 A1 * 6/2007 Meesey ..... A45F 3/08 224/649
2007/0187444 A1 * 8/2007 Hajari ..... A01M 31/02 224/155
2009/0084821 A1 * 4/2009 Lenzi ..... A45F 3/08 224/155
2009/0255756 A1 * 10/2009 Green ..... A62B 35/0012 182/3
2011/0042427 A1 * 2/2011 Goransson-Sonnefelt ..... F41C 33/005 224/149
2011/0186611 A1 * 8/2011 Eberle ..... A45F 4/00 224/583
2012/0292353 A1 * 11/2012 Andersen ..... A45F 3/06 224/149
2014/0151413 A1 * 6/2014 Ponder ..... F41C 33/007 224/149
2015/0237993 A1 * 8/2015 Gruver ..... A45F 4/10 224/153
2016/0033235 A1 * 2/2016 Kinnings ..... F41H 1/02 2/102
2016/0037895 A1 * 2/2016 Humphreys ..... A45F 3/08 224/633

* cited by examiner

BACKPACK FOR CARRYING WEAPONS

CROSS REFERENCE TO RELATED APPLICATIONS

This is a non-provisional application based upon U.S. provisional patent application Ser. No. 62/261,630, entitled "BACKPACK FOR CARRYING WEAPONS", filed Dec. 1, 2015, which is incorporated herein by reference.

BACKGROUND OF THE INVENTION

1. Field of the Invention

The present invention relates to backpacks, and, more particularly, to backpacks for carrying weapons, such as long guns or archery bows.

2. Description of the Related Art

Backpacks are generally used to carry various articles, such as books, food, etc. In the case of backpacks used for hunting or military applications, they can carry optics, food, water, survival gear, bedding, etc. They can also be used to carry weapons, such as long guns or archery bows.

Backpacks used to carry weapons, especially long guns or archery bows, can broadly be categorized on the basis of whether the backpack houses the weapon internally in a built-in scabbard or externally by fixing the weapon adjacent to an outer surface of the backpack. Both types of backpacks share advantages in that they lesson the encumbrance of carrying a weapon, better protect the weapon during transport, and increase the overall safety of the activity being performed.

The assignee of the present invention, Eberlestock USA, LLC, is a leader in the industry for the design and manufacture of backpacks for the military and hunting markets. Eberlestock makes and sells backpacks with internal rifle scabbards which allow a soldier or hunter to carry a long gun internally within the pack, out of the way, and close against the body of the user; thereby, allowing use of both hands by the user. For example, U.S. Pat. No. 6,763,987 (Eberle) provides a long pocket or scabbard for the carriage of a long gun. Such scabbards are limited in design as the dimension of the scabbard generally dicta the dimension of the surrounding backpack, and furthermore, albeit effective for stowing and carrying long guns, they are not configured for carrying other types of weapons such as archery bows.

Eberlestock also makes and sells backpacks without an internal scabbard that can be used to carry multiple types of weapons. For example, U.S. Pat. No. 7,735,701 (Eberle) discloses a backpack with a lower open pocket for receiving the lower end of the weapon, and an upper tether which loops around the upper portion of the weapon. The tether has one end affixed to one of the shoulder straps, and an opposite end which is detachably coupled to the same shoulder strap. This configuration allows the user to remove the weapon without removing the backpack. The user grasps the upper portion of the weapon above his shoulders with a hand opposite the attachment location of the tether, and then detaches the tether with the hand on the same side as the tether is attached to the shoulder strap. The weapon can then be removed from the lower pocket, without removing the backpack. This type of weapon carrying arrangement is effective but occasionally the weapon can work its way to the same side of the pack that the tether is attached, which then causes a lopsided load on the user, and allows the weapon to fall to one side of the pack. As the weapon is no longer symmetrically displaced, the lopsided configuration may cause discomfort to the user and damage the weapon.

What is needed in the art is a backpack that effectively carries multiple types of weapons on the back of the user.

SUMMARY OF THE INVENTION

The present invention provides a backpack with a weapon carrier that evenly secures a weapon such that it maintains a substantially upright position.

The invention in one form is directed to a backpack for carrying a weapon that includes a main body with a first shoulder strap and a second shoulder strap attached thereto. The backpack additionally includes a weapon carrier that has a lower pocket attached to a lower portion of the backpack for receiving an end of the weapon, and a tether having a first end and a second end respectively attached to the first and second shoulder straps of the backpack. When the weapon is positioned in the lower pocket, the tether wraps around the weapon to secure the weapon against an outer periphery of the main body of the backpack.

An advantage of the present invention is that it prevents a weapon from leaning to a side of a backpack and thereby prevents an uneven load.

Another advantage of the present invention is that a user can easily secure and remove the weapon from the backpack while the user is wearing the backpack.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, and such exemplification is not to be construed as limiting the scope of the invention in any manner.

DETAILED DESCRIPTION OF THE INVENTION

Figure 1:
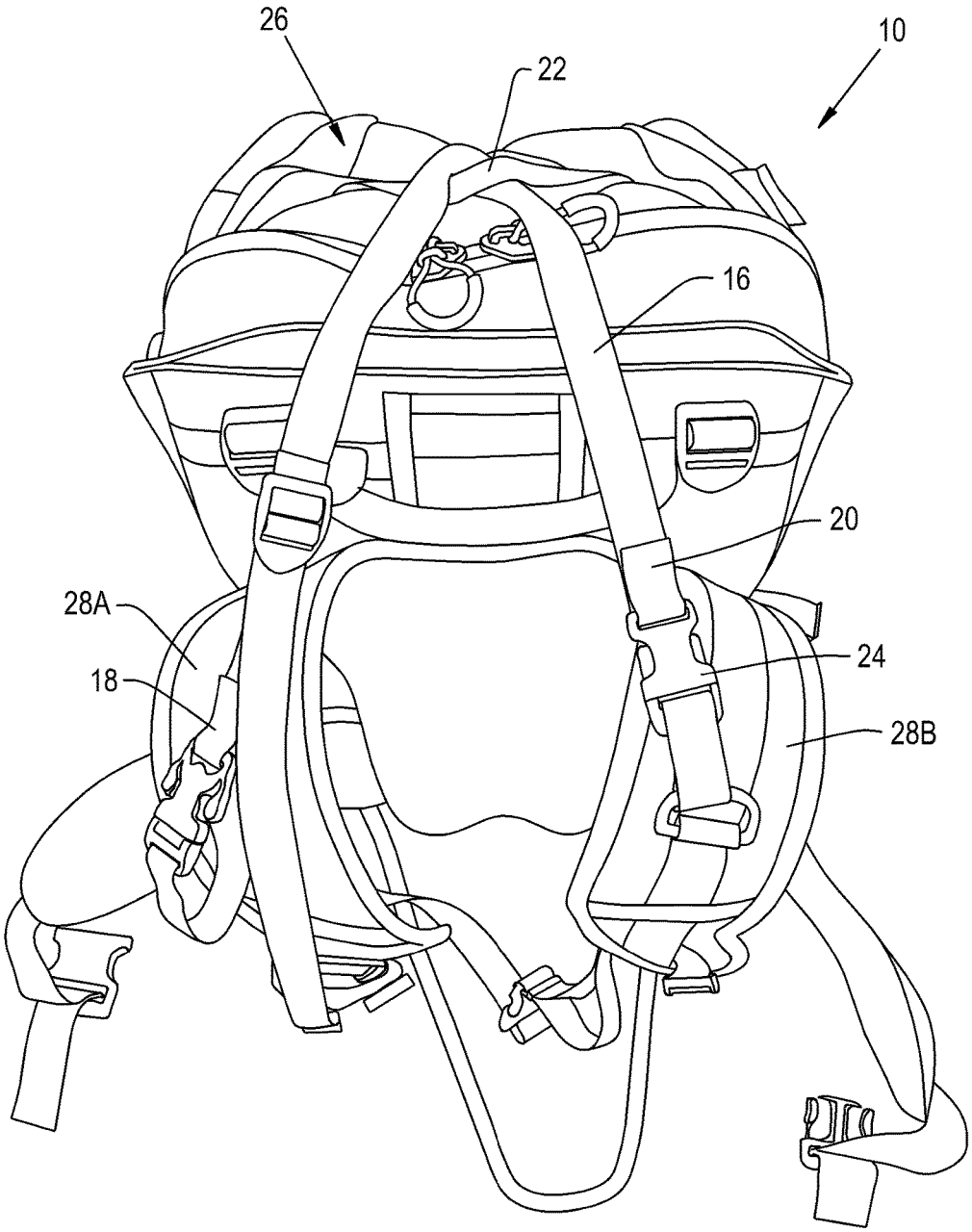
FIG. 1 is a top perspective view of a backpack, including an embodiment of a weapon carrier of the present invention.

Referring now to FIG. 1, there is shown a backpack 10, which has a main body 26 and a pair of shoulder straps 28A and 28B, with an embodiment of a weapon carrier 12 of the present invention. The weapon carrier 12 generally includes a lower pocket 14 and a tether 16.

The lower pocket 14 is attached to a lower portion of the backpack and can be of a known design, such as shown in U.S. Pat. No. 7,735,701.

The tether 16 has a first end 18 which is affixed to the shoulder strap 28A, and an opposite, second end 20 which is affixed to the opposite shoulder strap 28B. In the illustrated embodiment, the first end 18 is non-detachably affixed to the shoulder strap 28A (such as by sewing), and the second end 20 of the tether 16 is detachably affixed to the shoulder strap 28B (such as with a buckle). However, for other applications it is possible for both ends 18, 20 of the tether 16 to be detachably coupled with a respective shoulder strap 28A, 28B, thereby allowing the detachment of the tether 16 with either hand by the user. The tether 16 is designed to be long enough in order to attach to the shoulder straps 28A, 28B and wrap around an outer periphery of the main body 26 of the backpack 10. The tether 16 can be configured as a strap, rope, cord, etc. The tether 16 may be made from nylon, Kevlar®, or other suitable synthetic composite fiber materials.

The weapon carrier 12 also can include a securement 22 which is attached to the main body 26 of the backpack 10, and helps to maintain the tether 16 in a position out of the way and secure, when the weapon 30 is not in place. The securement 22 can also be used with the weapon 30 in place. Thereby, the securement 22 connects an intermediate portion of the tether 16 to the backpack 10 for guiding the tether 16. In the illustrated embodiment, the securement 22 is shown as a loop allowing the tether 16 to pass therethrough. The securement 22 can also function as a top handle allowing a user to carry the backpack 10. The securement 22 can be in the form of a D ring, strap, etc. which allows passage of the tether 16.

The tether 16 may also include a detachable coupler 24 on one or both of its ends 18, 20. In the present embodiment, the second end 20 of the tether 16 includes the detachable coupler 24 for easily fastening and unfastening the end 20 to the shoulder strap 28B. When configured with detachable couplers 24 at both ends 18, 20, the weapon carrier 12 accommodates for right or left-handed users. The coupler 24 can be in the form of a buckle, a hook, Velcro®, a loop, etc.

Figure 2:
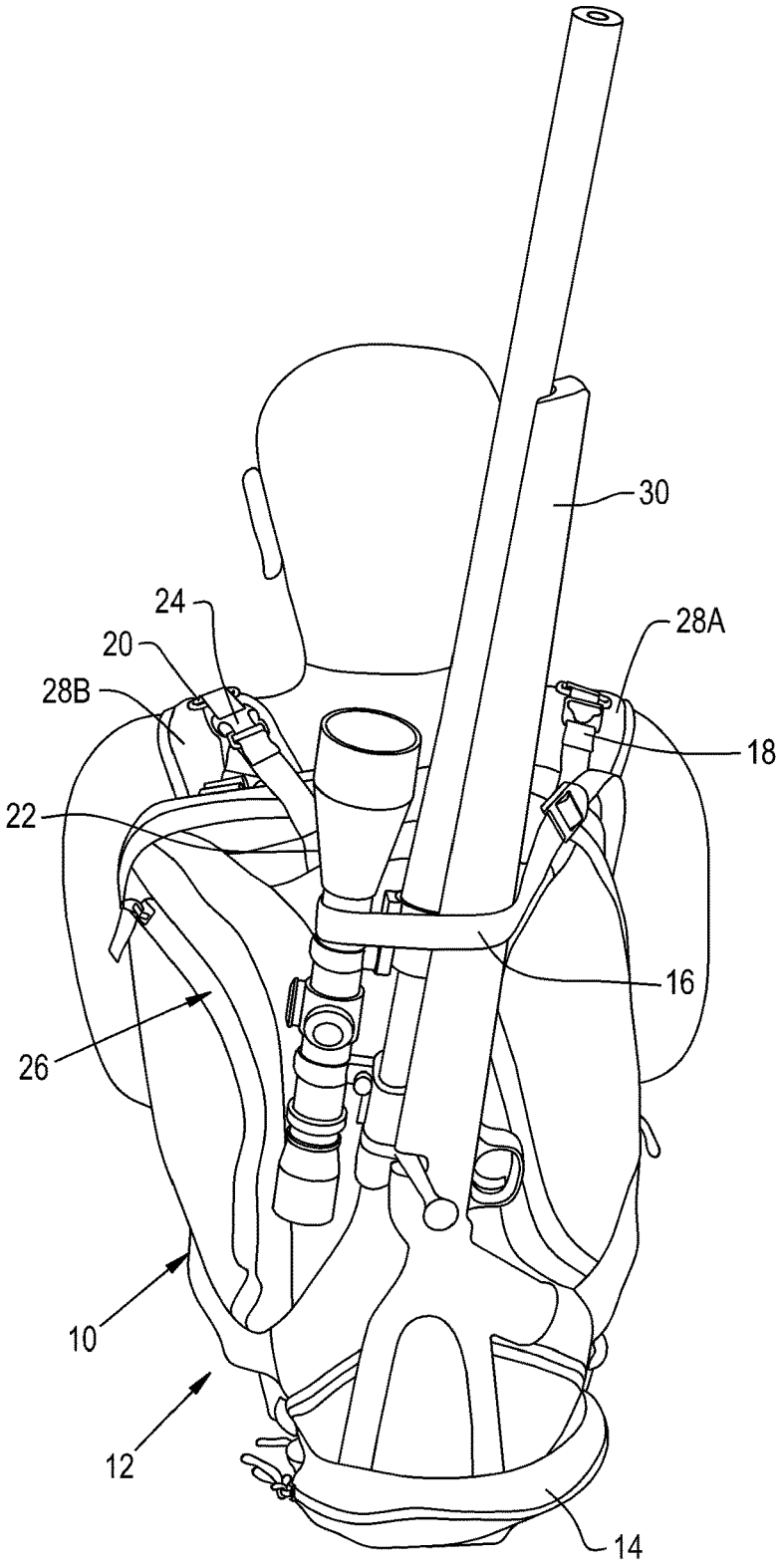
FIG. 2 is a rear perspective view of the weapon carrier as shown in FIG. 1 with a long gun disposed therein.

Referring now to FIG. 2, there is shown a user wearing the backpack 10 according to the present invention with a weapon 30 positioned in the weapon carrier 12. The weapon 30 may be in the form of a long gun, such as a hunting rifle, or an archery bow, such as a crossbow. To secure the weapon 30, a user places the end of the weapon 30 within the lower pocket 14, and then secures the weapon 30 by wrapping the tether 16 around the weapon 30. In this regard, the second end 20 of the tether 16 is first unfastened, moved around the weapon 30, and is then reattached to the shoulder strap 28B. Since the first and second ends 18, 20 of the tether 16 are affixed to a respective shoulder strap 28A, 28B, the forces acting on the weapon 30 are more evenly balanced. The tether 16 wraps around the weapon 30 to simultaneously apply a first securement force that secures the weapon 30 toward one shoulder of the user and a second securement force that secures the weapon 30 toward the other shoulder of the user so that the weapon is evenly secured against the outer periphery of the main body 26 of the backpack 10. Thereby, the weapon 30 is substantially upright and remains centered throughout the duration of an activity because the tether 16 inhibits the weapon 30 from leaning to a side of the backpack 10 and thus it prevents an unwelcomed and uneven distribution of weight. In other words, the weapon 30 is inhibited from working to one side of the backpack 10. To remove the weapon 30, a user unfastens the second end 20 of the tether 16, grasps the weapon, and then pulls the weapon 30 upwardly out of the weapon carrier 12 and over the user's shoulder. Both actions of securing and removing the weapon 30 in and out of the weapon carrier 12 can easily be accomplished while the user is wearing the backpack 10.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A backpack for carrying a weapon, comprising: a main body with a first shoulder strap and a second shoulder strap attached thereto; and a weapon carrier, including: a lower pocket attached to a lower portion of the backpack for receiving an end of the weapon; and a tether having a first end and a second end respectively attached to the first and second shoulder straps of the backpack, when the weapon is positioned in the lower pocket the tether wraps around the weapon to simultaneously apply a first securement force configured for securing the weapon toward a first shoulder of a user and a second securement force configured for securing the weapon toward a second shoulder of the user to secure the weapon against an outer periphery of the main body of the backpack; and wherein said weapon carrier further includes a securement attached to the main body of the backpack that connects an intermediate portion of the tether to the backpack for guiding the tether.

2. The backpack of claim 1, wherein said first end of the tether is non-detachably affixed to the first shoulder strap and said second end of the tether is detachably affixed to the second shoulder strap.

3. The backpack of claim 2, wherein the user of the backpack can easily detach the second end of the tether to remove the weapon from the weapon carrier by grasping the weapon and pulling the weapon over a shoulder while the user wears the backpack.

4. The backpack of claim 2, wherein said second end of the tether includes a detachable coupler for removably attaching the tether to said second should strap.

5. The backpack of claim 4, wherein said detachable coupler is at least one of a buckle, a hook, Velcro®, and a loop.

6. The backpack of claim 1, wherein said tether secures the weapon in a substantially upright position and inhibits the weapon from causing a lopsided distribution of weight.

7. The backpack of claim 1, wherein said securement is at least one of a strap, a D-ring, and a loop, which allows passage of the tether.

8. The backpack of claim 1, wherein said tether is at least one of a strap, a rope, and a cord.

9. The backpack of claim 1, wherein said tether is made from a synthetic composite fiber material.

* * * * *